US005919355A

United States Patent [19]

Hood

[11] Patent Number: 5,919,355

[45] Date of Patent: Jul. 6, 1999

[54] METHOD OF AND APPARATUS FOR PROCESSING HEAVY HYDROCARBONS

[75] Inventor: Richard L. Hood, Edmond, Okla.

[73] Assignee: Ormat Industries Ltd, Yavne, Israel

[21] Appl. No.: 08/862,437

[22] Filed: May 23, 1997

[51] Int. Cl.[6] ..... C10C 3/00

[52] U.S. Cl. ..... 208/309; 208/86; 208/87; 208/96; 196/14.52

[58] Field of Search ..... 208/309, 86, 87, 208/96; 196/14.52

[56] References Cited

U.S. PATENT DOCUMENTS

| | | | |
|---|---|---|---|
| 4,017,383 | 4/1977 | Beavon | 208/309 |
| 4,279,739 | 7/1981 | Roach | 208/309 |
| 4,454,023 | 6/1984 | Lutz | 208/96 |
| 4,568,451 | 2/1986 | Greewood et al. | 208/340 |
| 4,686,028 | 8/1987 | Van Driesen | 208/86 |
| 4,721,557 | 1/1988 | Staggs | 208/68 |
| 4,784,753 | 11/1988 | Hotier et al. | 208/309 |
| 5,089,114 | 2/1992 | Tovar et al. | 208/50 |
| 5,192,421 | 3/1993 | Audeh et al. | 208/309 |
| 5,258,117 | 11/1993 | Kolstad | 208/309 |

*Primary Examiner*—Helane Myers
*Attorney, Agent, or Firm*—Nath & Associates; Donald M. Sandler; Gary M. Nath

[57] ABSTRACT

A fractioning solvent deasphalting plant applies a solvent whose critical temperature is $T_c$ to a hydrocarbon feed containing asphaltenes and atmospheric distillate having fractions that boil above about $T_c$–50° F. such that said feed is separated into a substantially solvent-free product stream of atmospheric distillate, a substantially solvent-free product stream containing deasphalted oil substantially free of said atmospheric distillate, and a substantially solvent-free product stream containing asphaltenes substantially free of said atmospheric distillate.

24 Claims, 3 Drawing Sheets

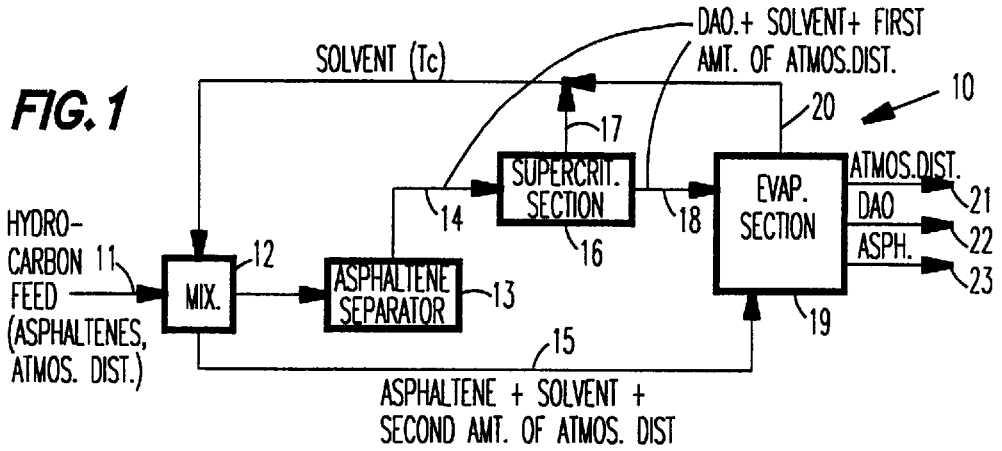
FIG. 1
SOLVENT (Tc)
DAO.+ SOLVENT+ FIRST AMT. OF ATMOS.DIST.
10
20
17
SUPERCRIT. SECTION
EVAP. SECTION
ATMOS.DIST.
DAO
ASPH.
21
22
23
HYDRO-CARBON FEED (ASPHALTENES, ATMOS. DIST.)
11
12
MIX.
ASPHALTENE SEPARATOR
13
14
16
18
19
15
ASPHALTENE + SOLVENT + SECOND AMT. OF ATMOS. DIST

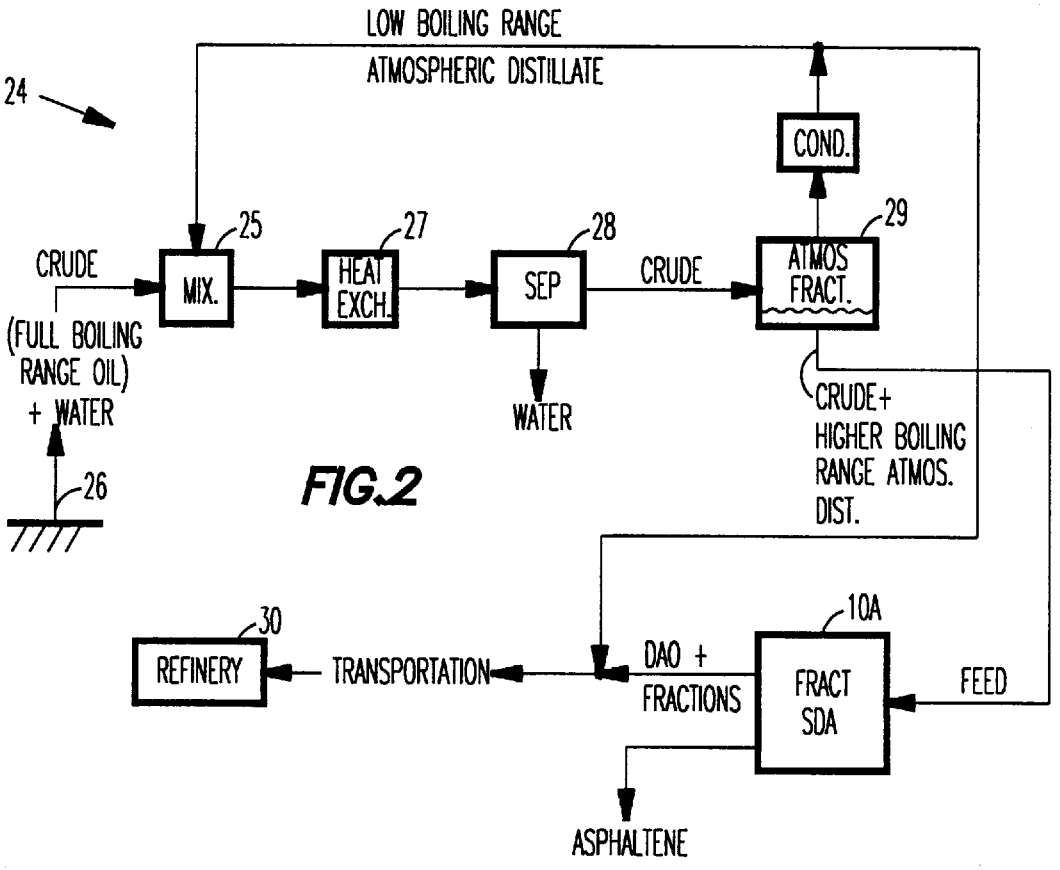
LOW BOILING RANGE ATMOSPHERIC DISTILLATE
24
COND.
29
CRUDE
(FULL BOILING RANGE OIL) + WATER
25
MIX.
27
HEAT EXCH.
28
SEP
CRUDE
ATMOS FRACT.
WATER
CRUDE+ HIGHER BOILING RANGE ATMOS. DIST.
26
FIG. 2
30
REFINERY
TRANSPORTATION
DAO + FRACTIONS
10A
FRACT SDA
FEED
ASPHALTENE

METHOD OF AND APPARATUS FOR PROCESSING HEAVY HYDROCARBONS

TECHNICAL FIELD

This invention relates to a method of and apparatus for processing heavy hydrocarbons, e.g., crude oil, vacuum residual produced by refining crude oil, etc., utilizing a solvent deasphalting process.

BACKGROUND OF THE INVENTION

Conventionally, a solvent deasphalting (SDA) unit is employed by an oil refinery for the purpose of extracting valuable components from vacuum residual, or residual oil, which is a heavy hydrocarbon produced as a by-product of refining crude oil. The extracted components are fed back to the refinery wherein they are converted into valuable lighter fractions such as gasoline, etc.

In a typical SDA unit, a light hydrocarbon solvent such as propane, iso- or normal butane, iso- or normal pentane, or mixtures thereof, is added to the heavy hydrocarbon feed from a refinery and applied to what is termed an asphaltene separator. Under elevated temperature and pressures, the mixture in the separator separates into a plurality of liquid streams, typically, a substantially asphaltene-free stream of deasphalted oil (DAO) and solvent, and a mixture of asphaltene and solvent within which some DAO may be dissolved. Sometimes, one or more substantially asphaltene-free streams of resin and solvent are also produced by treating the DAO with another lighter solvent, or by heating, or depresurizing the stream of DAO and solvent before supplying the stream to another separator.

The solvent recovery section of an SDA unit extracts essentially all of the solvent from these streams producing a solvent-free DAO product stream, and solvent-free asphaltene product stream. The DAO stream usually is returned to the refinery for conversion to gasoline, jet fuel, etc., and the asphaltene stream usually is combined with diluent, such as diesel fuel, for conversion to residual fuel oil.

In some installations, the solvent recovery operation includes a supercritical solvent recovery section that removes a large percentage of solvent from the stream of DAO and solvent, followed by an evaporative solvent recovery section that removes the remaining solvent from the DAO, and all of the solvent from the stream of asphaltene and solvent. In other installations, only an evaporative solvent recovery section is used. In both cases, the output of the evaporative solvent recovery section is DAO product and asphaltene product having acceptable levels of solvent (e.g., less than about 0.05% by weight).

In an evaporative solvent recovery section, each of the liquid product streams of DAO and solvent, or asphaltene and solvent, is first flashed to produce a vaporized solvent stream, and a reduced solvent liquid product stream. Each reduced solvent liquid product stream so produced is then subjected to serial flashing and/or stripping until the final product stream is free of solvent to the desired degree. The vaporized solvent produced in this manner is condensed and re-used by application to the hydrocarbon feed. An example of an evaporative solvent recovery section is disclosed in copending applications Ser. No. 08/618,570 filed Mar. 20, 1996, the disclosure of which is hereby incorporated by reference.

Vacuum residual produced by a refinery is a heavy viscous material that is usually solid at room temperature complicating its storage and transport. By mixing vacuum residual with atmospheric distillate (e.g., kerosene, diesel fuel, etc.) produced by a refinery, the viscosity of the mixture is reduced thereby facilitating its transportation. However, the presence of atmospheric distillate, from any source, in the heavy hydrocarbon feed applied to an SDA unit results in the trapping of the distillate in the solvent loop.

The problem is that some of the atmospheric distillate passes out of the bottom of the asphaltene separator of the SDA unit with the asphaltenes/solvent stream, and the remainder of the atmospheric distillate passes out the top of the separator with the DAO/solvent stream. Recovery of the solvent in the evaporation process effected by the unit also results in recovery of the atmospheric distillate which remains trapped in the solvent. Without an outlet for the atmospheric distillate, the concentration thereof in the solvent increases over time inhibiting phase separation in the asphaltene separator. At some point, the concentration of atmospheric distillate becomes so large that phase separation ceases. When this occurs, the unit has to be shut down and the trapped atmospheric distillate removed from the system.

Front-end flashing of the feed before it is applied to an SDA unit is not normally effective to remove sufficient atmospheric distillate from the feed to solve the problem. Subjecting the feed to fractional distillation would be a solution. However, the cost of either of these expedients is prohibitive.

It is therefore an object of the present invention to provide a new and improved method of and apparatus for removing atmospheric distillate present in a heavy hydrocarbon feed containing asphaltenes during a solvent deasphalting operation.

BRIEF DESCRIPTION OF THE INVENTION

In accordance with the present invention, a solvent whose critical temperature is $T_c$ is applied to a hydrocarbon feed containing asphaltenes and atmospheric distillate having fractions that boil above about $T_c$−50° F. such that the feed is separated into a substantially solvent-free product stream of atmospheric distillate, a substantially solvent-free product stream containing deasphalted oil substantially free of the atmospheric distillate, and a substantially solvent-free product stream containing asphaltenes substantially free of the atmospheric distillate.

More particularly, the solvent is applied to the hydrocarbon feed by combining the solvent with the feed to separate the latter into a first liquid stream of deasphalted oil (with or without resins), solvent, and a first amount of the atmospheric distillate, and a second liquid stream of asphaltenes, solvent, and a second amount of the atmospheric distillate. The first stream is heated and flashed for producing a vaporized stream containing solvent and a portion of the first amount of the atmospheric distillate, and a liquid stream containing deasphalted oil, solvent, and the remainder of the first amount of the atmospheric distillate. The vaporized stream containing solvent and a portion of the first amount of the atmospheric distillate is cooled for forming a vaporized solvent stream substantially free of atmospheric distillate, and a liquid stream of atmospheric distillate, and a small amount of solvent.

Preferably, solvent from the liquid stream containing deasphalted oil, solvent, and the remainder of said first amount of said atmospheric distillate is stripped to produce a further vaporized stream containing solvent and some atmospheric distillate, and a liquid product stream containing deasphalted oil substantially free of solvent and atmospheric distillate. The liquid stream of atmospheric distillate and a small amount of solvent, and the further vaporized stream containing solvent and some atmospheric distillate are combined and cooled for forming a vaporized solvent stream substantially free of atmospheric distillate, and a substantially solvent-free product stream of atmospheric distillate.

In the preferred embodiment, the vaporized solvent stream substantially free of atmospheric distillate is expanded in a turbine for generating power and producing an expanded vaporized solvent stream substantially free of atmospheric distillate. The vaporized solvent stream substantially free of atmospheric distillate, and the expanded vaporized solvent stream are condensed to liquid solvent which is made available for application to the hydrocarbon feed.

BRIEF DESCRIPTION OF THE DRAWINGS

Embodiments of the present invention are described by way of the example with reference to the accompanying drawings wherein:

FIG. 1 is a schematic flow chart of a solvent deasphalting unit according to the present invention for recovering atmospheric distillate in the hydrocarbon feed to the unit, and producing a substantially solvent-free product stream of deasphalted oil, and a substantially solvent-free product stream of asphaltene;

FIG. 2 is a schematic representation showing the processing of a full boiling range oil (e.g., crude oil) by a solvent deasphalting unit according to the present invention located at the well-head, and the transportation of only relatively high value distillates and deasphalted oil to a remotely located refinery;

DETAILED DESCRIPTION

Figure 3:
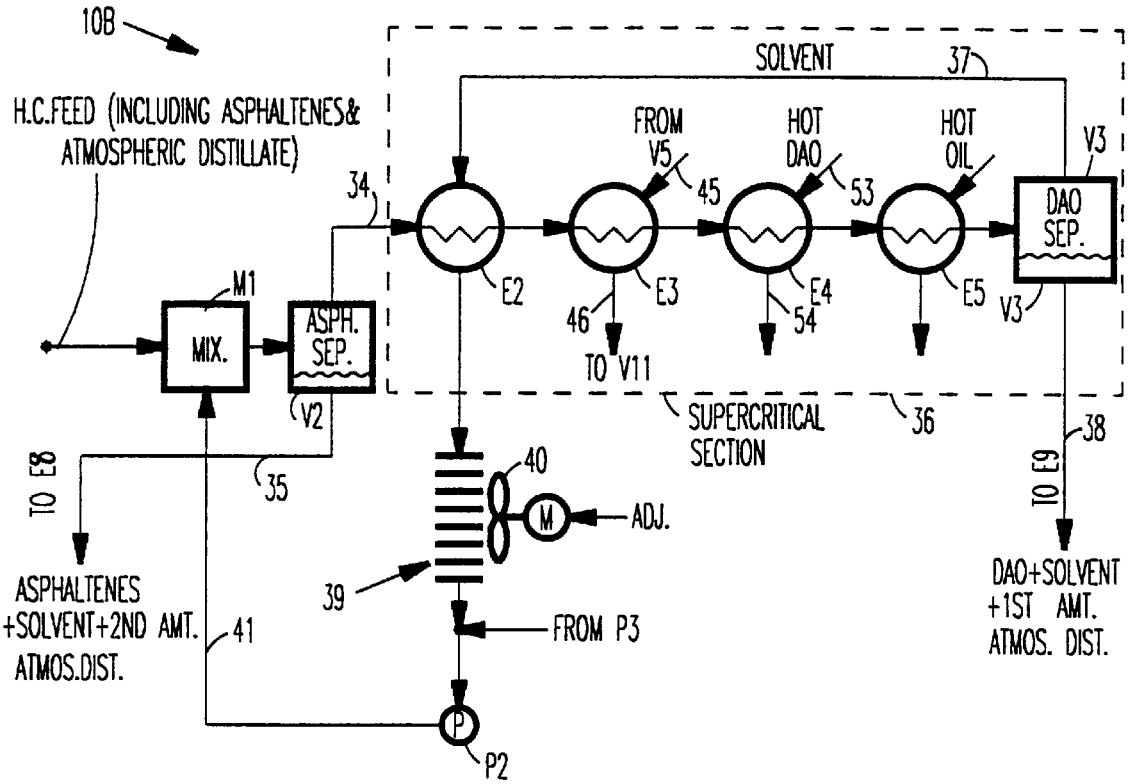
FIG. 3 is a block diagram of the present invention showing schematically the front end of a solvent deasphalting unit including a supercritical section.

Referring now to the drawings, reference numeral 10 in FIG. 1 designates what is termed herein, a fractionating solvent deasphalting unit according to the present invention, for applying a solvent whose critical temperature is $T_c$ to hydrocarbon feed 11 containing asphaltenes and atmospheric distillate, such as kerosene, etc. having fractions that boil above about $T_c$–50° F. The solvent is mixed at 12 with feed 11 and applied to asphaltene separator 13 wherein the mixture separates into two streams 14 and 15, the atmospheric distillate being divided between the two streams. Stream 14 contains DAO, solvent and a first amount of the atmospheric distillate in feed 11. Stream 15 contains a liquid stream of asphaltenes, solvent and a second amount of the atmospheric distillate in feed 11.

In optional supercritical section 16 of SDA unit 10, stream 14 is heated to above the critical temperature of the solvent, and separates into streams 17 and 18. Stream 17, which contains only a small amount of the atmospheric distillate in stream 14 and about 90% of the solvent in stream 14, is returned to mixer 12; and stream 18 contains DAO, about 10% of the solvent in stream 14, and most of the atmospheric distillate in stream 14. Evaporative section 19 receives stream 18 and is effective, as described in detail below, to separate stream 18 into stream 20 of solvent substantially free of atmospheric distillate which is returned to mixer 12, and at least three product streams. Product stream 21 is a stream of substantially solvent-free atmospheric distillate; product stream 22 is a stream of substantially solvent-free deasphalted oil substantially free of the atmospheric distillate; and stream 23 is a stream of substantially solvent-free asphaltenes substantially free of the atmospheric distillate.

While the apparatus of FIG. 1 shows the production of asphaltenes and DAO, this showing is representative of apparatus that produces asphaltenes, DAO, and one or more resins using additional, serially applied lighter solvents, or separators operating at higher temperatures. The extraction of the atmospheric distillate in feed 11, however, is independent of whether or not resins are extracted from the SDA unit.

As shown in FIG. 2, a fractionating SDA unit, like that shown at 10 in FIG. 1, can be applied to a full boiling range oil, such as crude oil, which contains fractions with initial, atmospheric boiling points from about 95° F. to about 1500° F. For example, fractionating SDA unit 10A can be used to pre-treat crude oil in the oil field for the purpose of site-extraction of relatively low-value asphaltenes from the crude oil, most of which could be burned on-site for heating purposes in connection with the extraction of oil from the ground. In this manner, only high-value DAO and any lower boiling fractions in the crude oil would be transported to a refinery.

While the fractionating SDA unit of the present invention can extract atmospheric distillate in crude oils which have fractions that boil above about $T_c$–50° F., fractions in the crude that boil below this temperature would adversely affect the operation of the SDA unit for the reasons indicated above. To remove these fractions from the crude, and thus permit efficient operation of a fractionating SDA unit, front-end processing apparatus 24 shown in FIG. 2 can be used.

Apparatus 24 includes mixer 25 that first mixes crude oil and water pumped with the crude from well 26 with low boiling range atmospheric distillate fractions (i.e., fractions whose initial, atmospheric pressure boiling points are less than about $T_c$–50° F.) obtained from atmospheric fractionator 29, then heats or cools the mixture at 27, and applies the mixture to separator 28. The presence of low boiling range atmospheric distillate fractions reduces the density of the crude in the separator, and permits the heavier water to sink to the bottom of separator 28 from which it can be drawn off. The water-free crude drawn from near the top of the separator is heated and then fractionated at 29 producing low boiling range atmospheric distillate fractions from the top of the atmospheric fractionator, and crude oil containing higher boiling range atmospheric distillate fractions (i.e., fractions whose atmospheric pressure boiling points are greater than about $T_c$–50° F.) from the bottom of the fractionator.

The higher boiling range atmospheric distillate fractions are condensed, and conventionally, some of these fractions are fed back to mixer 25 and the remainder are combined with the non-asphaltene output of the fractionating SDA unit 10A. The feed to the fractionating SDA unit is the bottom stream from atmospheric fractionator 29.

As described below, SDA unit 10A extracts the asphaltene from the crude leaving DAO and the valuable lower boiling range fractions in the crude available for storage and/or transportation to refinery 30 at a remote location. The extracted less-valuable asphaltene, instead of more valuable crude oil, or natural gas, which may be extracted with the crude oil, can be burned at the oil well to provide heat and steam for extracting oil from the well 26.

The front end 10B of a fractionating SDA unit according to the present invention is shown in FIG. 3 to which reference is now made. Hydrocarbon feed 31, such as vacuum residual, or crude oil pretreated as above, containing asphaltenes and atmospheric distillate, is applied to mixer M1 at a temperature no greater than about $T_c$. In mixer M1, solvent in line 41 recovered by the supercritical section, if present, and from storage tank 33 (FIG. 4) is mixed with the feed; and the mixture is applied to asphaltene separator V2 wherein separation takes place. Flowing from the top of the separator, is liquid stream 34 containing DAO, solvent, and a first amount of the atmospheric distillate in the feed. Flowing from the bottom of the separator, is second liquid stream 35 containing asphaltenes, solvent, and a second amount (i.e., the remainder) of the atmospheric distillate in the feed.

If a supercritical separation process is used, stream 34 is heated in supercritical section 36, typically using heat exchangers E2 and E5 (and optionally using heat exchangers E3 and E4 in order to conserve energy) until the temperature of stream 34, at the inlet to DAO separator V3 is higher than the critical temperature of the solvent. In the absence of a supercritical section, stream 34 is applied directly to evaporative section 19A of the unit (see FIG. 4).

As shown in FIG. 3, separator V3 is effective to separate the supercritical mixture of stream 34 into stream 37 of solvent that is substantially free of DAO and contains only a small amount of the atmospheric distillate in stream 34, and a first stream 38 of deasphalted oil, some solvent, and a first amount of atmospheric solvent present in feed 31. Stream 37 containing recovered solvent at about its critical temperature and some atmospheric distillate, is hotter than stream 34 entering heat exchanger E2, when it leaves separator V3, and is thus cooled before entering cooler 39 wherein the supercritical solvent is cooled to a liquid.

Although cooler 39 is shown as being air-cooled, this cooler also can be water cooled, or a heat exchanger that rejects heat by vaporizing an organic fluid, such as solvent used in the unit.

Liquid solvent from cooler 39 is combined with liquid solvent from storage tank 33 (FIG. 4) as required, and pumped by pump P2 via line 40 into mixer M1. The speed of fan 40 which cools condenser 39 is adjusted so that the temperature of the solvent being pumped at P2 is about 50° F. below the critical temperature of the solvent, taking into account the temperature of the solvent from tank 33 and the amount of the recovered solvent from separator V3.

Figure 4:
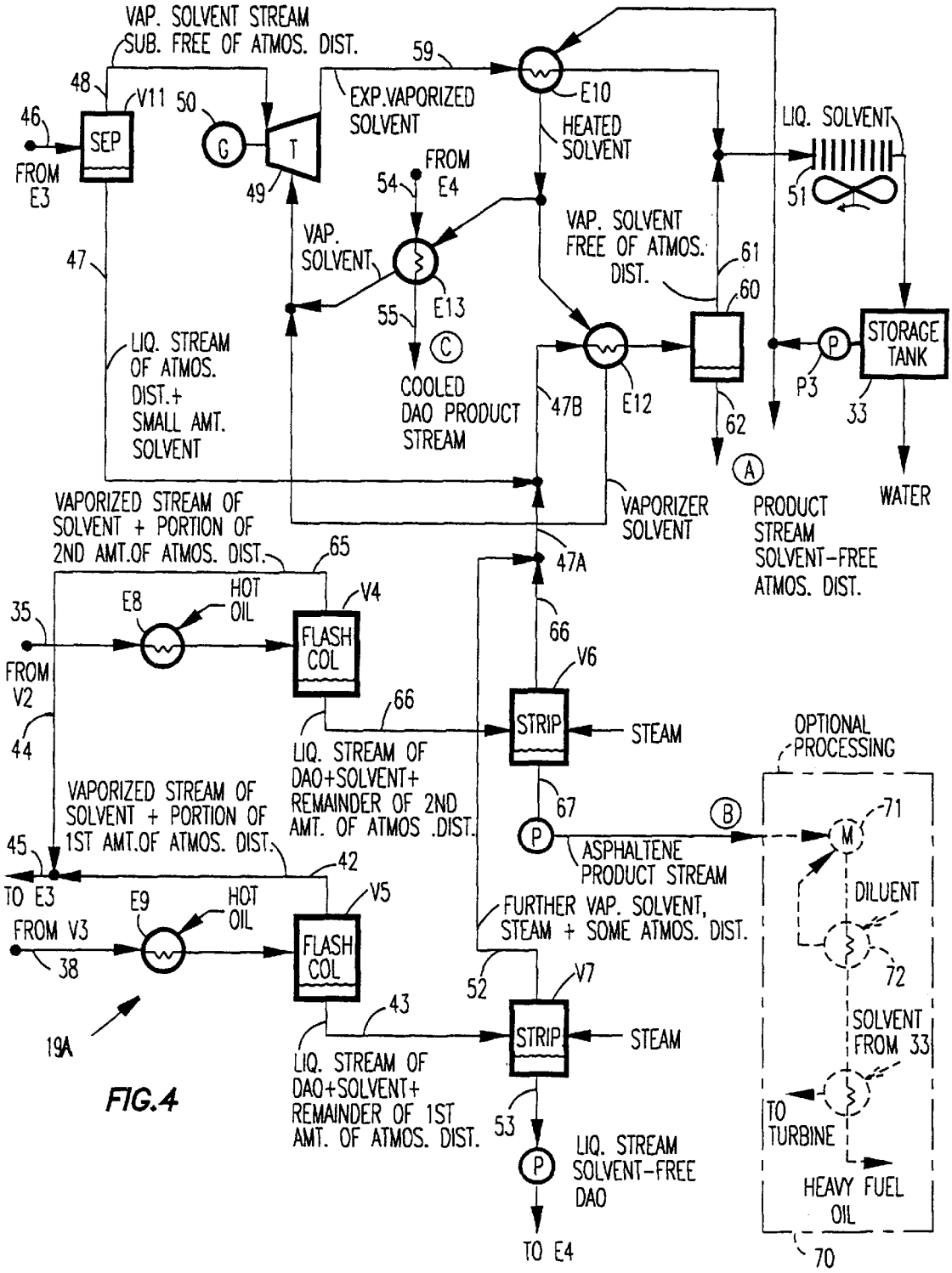
FIG. 4 is a block diagram showing the evaporative section of a solvent deasphalting unit of the present invention.

Referring now to FIG. 4 which shows the evaporative section 19A of the fractionating SDA unit of the invention, first liquid stream 38 (or stream 34 if the SDA unit does not employ a supercritical section) of DAO, solvent, and a first amount of atmospheric distillate in feed 31 is heated to a temperature above about 500° F. in heat exchanger E9 supplied with hot oil from a source (not shown) of heated oil. Alternatively, heat exchanger E9 can be a furnace. The heated stream flashes in flash column V5. In line 42 at the top of flash column V5 flows a vaporized stream of solvent and a portion of the first amount of the atmospheric distillate in stream 38; and line 43 at the bottom of the flash column flows a liquid stream of DAO, solvent, and the remainder of the first amount of atmospheric distillate in stream 38.

The vapor stream in line 42 and the vapor stream in line 44 (which contains a vaporized stream of solvent and a portion of the second amount of atmospheric distillate in stream 35, as described below) are combined in line 45 to form a combined stream that flows in line 45. Some of the heat in the combined stream, whose temperature is above about 500° F., may be recovered by indirectly contacting the stream with stream 34 by way of heat exchanger E3 in the process of raising the solvent to supercritical conditions in supercritical section 37. In this process, the temperature of the combined stream would be cooled to about the critical temperature of the solvent.

The overhead from flash columns V4 and V5 also could be cooled by indirect contact with streams 35 and 38. In such case, a heat exchanger would be installed between separator V2 and heat exchanger E8, and between DAO separator V3 and heat exchanger E9.

The cooled solvent, and atmospheric distillate in line 46 at the output of heat exchanger E3 is applied to separator V11 producing liquid stream 47 and vapor stream 48. Liquid stream 47, at the bottom of separator V11, contains atmospheric distillate and a small amount of solvent; and vapor stream 48 at the top of separator V11 carries vaporized solvent substantially free of atmospheric distillate.

The vaporized solvent in line 48 contains a significant amount of energy. Preferably, some of this energy is recovered in vapor turbine 49 connected to generator 50. The vaporized solvent expands in the turbine which drives the generator and produces heat-depleted, vaporized solvent that flows in line 59 to heat exchanger E10 which indirectly contacts this fluid with liquid solvent from storage tank 33 thereby heating the liquid solvent. The expanded, vaporized solvent in line 59 is condensed to a liquid in condenser 51. The condensed solvent is then returned to storage tank 33.

While condenser 51 is shown as being air-cooled, this condenser may also be water cooled. In a further modification, turbine 49 and generator 50, and heat exchanger E10 could be replaced by a pressure control valve. In such case, stream 48 would go directly to condenser 51 which would have a larger capacity than would be required for the arrangement shown in FIG. 4.

Liquid stream 43 of DAO, solvent, and the remainder of the first amount of atmospheric distillate flowing from the bottom of flash column V5 is applied to stripper V7. In the presence of steam applied to the stripper, essentially all of the liquid solvent and most of the atmospheric distillate in stream 43 is vaporized and removed via line 52 at the top of stripper V7 together with steam forming a stream of further vaporized solvent, steam and atmospheric distillate. Line 53 at the bottom of the stripper contains a liquid product stream of substantially solvent-free DAO (e.g., less than about 0.05% by weight solvent), at a temperature above about 500° F.

Some of the heat in this product stream can be recovered by indirectly contacting the stream in line 53 with the solvent in stream 34 by way of heat exchanger E4 in the process of raising the solvent to supercritical conditions in supercritical section 37. Additional heat needed to be removed to achieve the desired product temperature may be removed in heat exchanger E13 by indirectly contacting the partially cooled product stream exiting heat exchanger E4 with heated solvent from heat exchanger E10 thus forming cooled DAO product stream "C" in FIG. 4 which is available for storage or transportation.

Stream 52 of further vaporized solvent, steam, and some atmospheric distillate from the overhead of stripper V7 combines with stream 66 from stripper V6 to form a combined stream 47A. The combined stream is then combined with liquid stream 47 of atmospheric distillate and a small amount of solvent from the bottom of separator V11 to form stream 47B which is applied to heat exchanger E12. Heat contained in combined stream 47B is transferred to heated solvent produced by heat exchanger E10 producing vaporized solvent that may be expanded in a turbine, preferably at an intermediate stage of turbine 49. Heat removed from DAO product stream 54 by heat exchanger E13 also may be used to vaporize solvent heated by heat exchanger E10 producing vaporized solvent that may be expanded in a turbine for heat recovery purposes.

Alternatively, combined stream 47B could be cooled by an air cooled or a water cooled heat exchanger that reduces the temperature of the stream to a value below the boiling point of the atmospheric distillate, but above the boiling point of the solvent.

The stream of atmospheric distillate and solvent in line 47B, is cooled in heat exchanger E12, and then applied to separator 60. From the top of separator 60 flows stream 61 of vaporized solvent; and from the bottom flows product stream 62 of substantially solvent-free atmospheric distillate. Vaporized solvent, and steam from stripper V7 which flows in line 61 at the top of separator 60 are condensed, preferably by being combined with the expanded solvent in line 59 upstream of condenser 51.

In some circumstances, some of the steam in line 47B will condense in heat exchanger E12; and in such circumstances, a three layer regime will exist in separator 60. Water, being the heaviest, will be in the bottom layer of the separator and can be drawn off. Atmospheric distillate will occupy the middle layer and will come off in line 62. The upper layer will be vaporized solvent and steam that will come off the top of heat exchanger E12.

If feed 31 to the fractionating solvent deasphalting unit is vacuum residue from a refinery, product stream 62 of atmospheric distillate and product stream 55 of DAO are likely to be returned to the refinery for processing. If feed 31 is processed crude oil, product streams 55 and 62 are likely to be combined for transportation to a refinery.

The stream of asphaltenes, solvent, and the second amount of atmospheric distillate in line 35 (FIG. 3) is processed by evaporative section 19A of the fractionating SDA unit in a manner parallel to the processing of the DAO stream in line 38. That is to say, second liquid stream 35 of asphaltene, solvent, and a second amount of atmospheric distillate in feed 31 is heated to above about 525° F. in heat exchanger E8 which receives hot oil from a source (not shown) of heated oil. Alternatively, element E8 could be a furnace. The heated stream flashes in flash column V4. In line 65 at the top of flash column V4 flows a vaporized stream of solvent and a portion of the second amount of the atmospheric distillate in stream 35; and in line 66 at the bottom of the flash column flows a liquid stream of asphaltene, solvent, and the remainder of the second amount of atmospheric distillate in stream 35.

As indicated above, stream 65 from flash column V4 is combined with stream 42 from flash column V5. The combined stream 45 is cooled and then separated at V11 into vaporized solvent substantially free of atmospheric distillate which is expanded in turbine 49 and a liquid stream of atmospheric distillate and a small amount of solvent which is cooled and then separated at 60.

Stream 66 from flash column V4 is applied to stripper V6 where, in the presence of steam applied to the stripper, essentially all of the liquid solvent and nearly all of the atmospheric distillate in stream 43 is vaporized and removed via line 66 at the top of the stripper together with steam forming a stream of further vaporized solvent, steam, and atmospheric distillate. Line 67 at the bottom of the stripper contains a liquid product stream "B" of substantially solvent-free asphaltene (e.g., less than about 0.05% by weight solvent), at a temperature above about 525° F.

Some of the heat in this product stream can be recovered as this product is converted to heavy fuel oil in optional processing equipment 70. When equipment 70 is present, asphaltene product in line 67 is first mixed at 71 with a diluent (e.g., diesel fuel) that is preheated in heat exchanger 72 wherein the diluent is indirectly contacted with the mixture of asphaltene and diluent. The still hot mixture may then be cooled by indirect contact with solvent from storage tank 33, the solvent being vaporized by such indirect contact. Heat in the vaporized solvent can be recovered by expanding the vaporized solvent in a turbine.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. A method for applying a solvent whose critical temperature is $T_c$ to a hydrocarbon feed containing asphaltenes and atmospheric distillate having fractions that boil above about $T_c$−50° F. such that said feed is separated into a substantially solvent-free product stream of atmospheric distillate, a substantially solvent-free product stream containing deasphalted oil substantially free of said atmospheric distillate, and a substantially solvent-free product stream containing asphaltenes substantially free of said atmospheric distillate.

2. A method according to claim 1 wherein the solvent is applied to said hydrocarbon feed by:

a) combining said solvent with said hydrocarbon feed to separate said feed into a first liquid stream of deasphalted oil, solvent, and a first amount of said atmospheric distillate, and a second liquid stream of asphaltenes, solvent, and a second amount of said atmospheric distillate;

b) heating and then flashing said first stream for producing a vaporized stream containing solvent and a portion of said first amount of said atmospheric distillate, and a liquid stream containing deasphalted oil, solvent, and the remainder of said first amount of said atmospheric distillate; and c) cooling said vaporized stream containing solvent and most of said first amount of said atmospheric distillate for forming a vaporized solvent stream substantially free of atmospheric distillate, and a liquid stream of atmospheric distillate, and a small amount of solvent.

3. A method according to claim 2 including expanding said vaporized solvent stream substantially free of atmospheric distillate in a turbine for generating power and producing an expanded vaporized solvent stream substantially free of atmospheric distillate.

4. A method according to claim 2 including stripping solvent from said liquid stream containing deasphalted oil, solvent, and the remainder of said first amount of said atmospheric distillate to produce a further vaporized stream containing solvent, steam and atmospheric distillate, and a liquid product stream containing deasphalted oil substantially free of solvent and atmospheric distillate.

5. A method according to claim 4 including cooling and combining said liquid stream of atmospheric distillate, and a small amount of solvent, and said further vaporized stream containing solvent, steam and atmospheric distillate for forming a vaporized solvent stream substantially free of atmospheric distillate, and a substantially solvent-free product stream of atmospheric distillate.

6. A method according to claim 5 including condensing said vaporized solvent stream substantially free of atmospheric distillate, and said expanded vaporized solvent stream to liquid solvent.

7. A method according to claim 6 including indirectly contacting some of said liquid solvent with said expanded vaporized solvent stream to form heated solvent, and thereafter indirectly contacting said heated solvent with said heated liquid product stream containing deasphalted oil substantially free of solvent and of atmospheric distillate to form vaporized solvent.

8. A method according to claim 7 including expanding said vaporized solvent in a turbine.

9. A method according to claim 2 including:

a) heating and then flashing said second liquid stream for producing a vaporized stream containing solvent and a portion of said second amount of atmospheric distillate, and a liquid stream containing asphaltene, solvent, and the remainder of said second amount of said atmospheric distillate; and b) cooling said vaporized stream containing solvent and most of said second amount of atmospheric distillate for forming a vaporized solvent stream substantially free of atmospheric distillate, and a liquid stream of atmospheric distillate.

10. A method according to claim 9 including stripping solvent from said liquid stream containing asphaltene, solvent and the remainder of said second amount of atmospheric distillate to produce a further vaporized stream containing solvent, steam, and atmospheric distillate, and a liquid product stream containing asphaltene substantially free of solvent and atmospheric distillate.

11. A fractionating solvent deasphalting unit comprising:

a) a source of solvent having a critical temperature $T_c$; and b) a hydrocarbon feed containing asphaltenes and atmospheric distillate having fractions that boil above about $T_c$–50° F.; and c) apparatus for applying said solvent to said feed for producing a substantially solvent-free product stream of atmospheric distillate, a substantially solvent-free product stream containing deasphalted oil substantially free of said atmospheric distillate, and a substantially solvent-free product stream containing asphaltenes substantially free of said atmospheric distillate.

12. Apparatus according to claim 11 wherein said apparatus includes:

a) a separator for receiving a mixture of said solvent and said hydrocarbon feed and separating said feed into a first liquid stream of deasphalted oil, solvent, and a first amount of said atmospheric distillate, and a second liquid stream of asphaltenes, solvent, and a second amount of said atmospheric distillate;

b) means for heating and then flashing said first stream for producing a vaporized stream containing solvent and most of said first amount of said atmospheric distillate, and a liquid stream containing deasphalted oil, solvent, and the remainder of said first amount of said atmospheric distillate; and c) means for cooling said vaporized stream containing solvent and most of said first amount of said atmospheric distillate for forming a vaporized solvent stream substantially free of atmospheric distillate, and a liquid stream of atmospheric distillate and a small amount of solvent.

13. Apparatus according to claim 12 including a vapor turbine for expanding said vaporized solvent stream substantially free of atmospheric distillate and generating power, and for producing an expanded vaporized solvent stream substantially free of atmospheric distillate.

14. Apparatus according to claim 12 including a stripper for stripping solvent from said liquid stream containing deasphalted oil, solvent and the remainder of said first amount of said atmospheric distillate to produce a further vaporized stream containing solvent, steam and atmospheric distillate, and a liquid product stream containing deasphalted oil substantially free of solvent and of atmospheric distillate.

15. Apparatus according to claim 14 including a means for cooling and combining said liquid stream of atmospheric distillate and a small amount of solvent, and said further vaporized stream containing solvent, steam, and atmospheric distillate for forming a vaporized solvent stream substantially free of atmospheric distillate, and a substantially solvent-free product stream of atmospheric distillate.

16. Apparatus according to claim 15 including a condenser for condensing said vaporized solvent stream substantially free of atmospheric distillate, and said expanded vaporized solvent stream to liquid solvent.

17. Apparatus according to claim 16 including a heat exchanger for indirectly contacting some of said liquid solvent with said expanded vaporized solvent stream to form heated solvent, and a heat exchanger for indirectly contacting said heated solvent with said heated liquid product stream containing deasphalted oil substantially free of solvent and of atmospheric distillate to form vaporized solvent.

18. Apparatus according to claim 17 including a vapor turbine for expanding said vaporized solvent.

19. Apparatus according to claim 12 including:

a) means for heating and then flashing said second liquid stream for producing a vaporized stream containing solvent and most of said second amount of atmospheric distillate, and a liquid stream containing asphaltene, solvent, and the remainder of said second amount of said atmospheric distillate; and b) means for cooling said vaporized stream containing solvent and most of said second amount of atmospheric distillate for forming a vaporized solvent stream substantially free of atmospheric distillate, and a liquid stream of atmospheric distillate.

20. Apparatus according to claim 19 including a stripper for stripping solvent from said liquid stream containing asphaltene, solvent and the remainder of said second amount of atmospheric distillate to produce a further vaporized stream containing solvent, steam, and atmospheric distillate, and a liquid product stream containing asphaltene substantially free of solvent and atmospheric distillate.

21. A method according to claim 7 including indirectly contacting said heated solvent with said liquid stream of atmospheric distillate and solvent, and with said further vaporized stream of solvent and some atmospheric distillate, for cooling the last mentioned streams.

22. A method according to claim 17 including a heat exchanger for indirectly contacting said heated solvent with said liquid stream of atmospheric distillate and solvent, and with said further vaporized stream of solvent and some atmospheric distillate, for cooling the last mentioned streams.

23. A method for processing a feed in the form of a full boiling range oil produced at a well-head comprising:

a) removing from the feed, fractions of atmospheric distillates whose initial boiling points are less than about $T_c$–50° F. to form a modified feed;

b) applying said modified feed to a fractionating SDA located in the vicinity of the well-head and which utilizes a solvent whose critical temperature is $T_c$ for producing a substantially solvent-free stream of atmospheric distillate, a substantially solvent-free product stream containing deasphalted oil substantially free of said atmospheric distillate, and a substantially solvent-free product stream containing asphaltenes substantially free of said atmospheric distillate; and c) transporting at least said substantially solvent-free stream of deasphalted oil to a refinery located remotely from the well-head.

24. A method according to claim 23 including combining at least some of said atmospheric distillate with said deasphalted oil for transport to said refinery.

* * * * *